United States Patent [19]

Dedo

[11] 4,004,579

[45] Jan. 25, 1977

[54] RESPIRATORY ASSIST DEVICE

[76] Inventor: Richard G. Dedo, 8629 La Losa Drive, West, Jacksonville, Fla. 32217

[22] Filed: Oct. 8, 1975

[21] Appl. No.: 620,647

[52] U.S. Cl. ..... 128/28

[51] Int. Cl.[2] ..... A61H 31/00

[58] Field of Search ..... 128/28, 24 R, 25 R, 128/78, 518 R, 518 B, 578, 96; 272/99, 109, 119

[56] References Cited

UNITED STATES PATENTS

| | | | |
|---|---|---|---|
| 1,074,846 | 10/1913 | Dickman et al. | 272/99 |
| 1,647,299 | 10/1927 | Konig | 272/80 |
| 2,104,699 | 1/1938 | O'Dell | 128/578 X |
| 2,520,063 | 8/1950 | Rishcoff | 128/578 X |
| 2,662,522 | 12/1953 | Muller | 128/518 B |
| 2,815,752 | 12/1957 | Forman | 128/578 X |
| 3,491,751 | 1/1970 | Wolfing | 128/28 |
| 3,503,388 | 3/1970 | Cook | 128/28 |
| 3,926,183 | 12/1975 | Spiro | 128/78 |

FOREIGN PATENTS OR APPLICATIONS

| | | | |
|---|---|---|---|
| 238,278 | 9/1911 | Germany | 128/28 |

OTHER PUBLICATIONS

Medical-Surgical Review, 1st. Qrtr. 1968, p. 22.

*Primary Examiner*—Lawrence W. Trapp
*Attorney, Agent, or Firm*—Powell L. Sprunger

[57] ABSTRACT

A respiratory assist device comprising, a garment of flexible material extending around the lower region of a wearer's rib cage, and a plurality of elongated compression straps retained on the garment. The straps have separate sets of circumferential side portions located on the garment adjacent opposed sides of the wearer and disposed to cover the lower region of the wearer's rib cage when the garment is worn. The straps have separate sets of end portions extending from the side portions toward a location intermediate the side portions when the garment is worn. The device also has means for separately joining different sets of the end portions, in order that the joining means may be pulled to compress the lower region of the wearer's rib cage and facilitate expiration.

20 Claims, 9 Drawing Figures

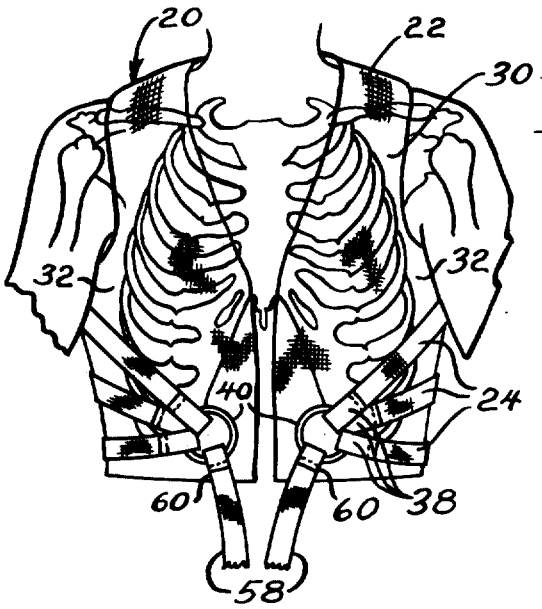
Fig. 5
Fig. 6
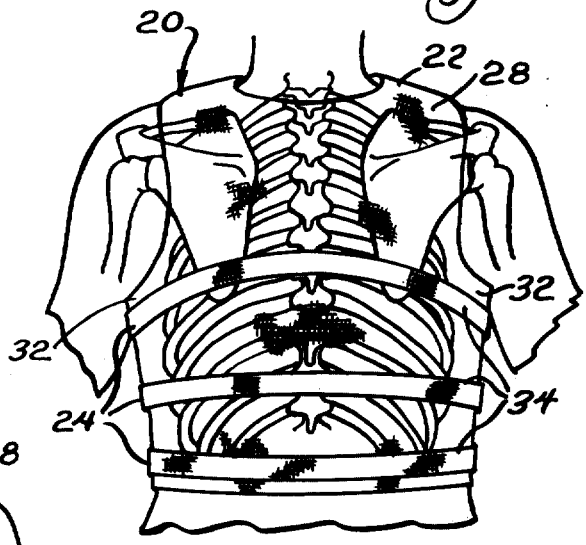
Fig. 7
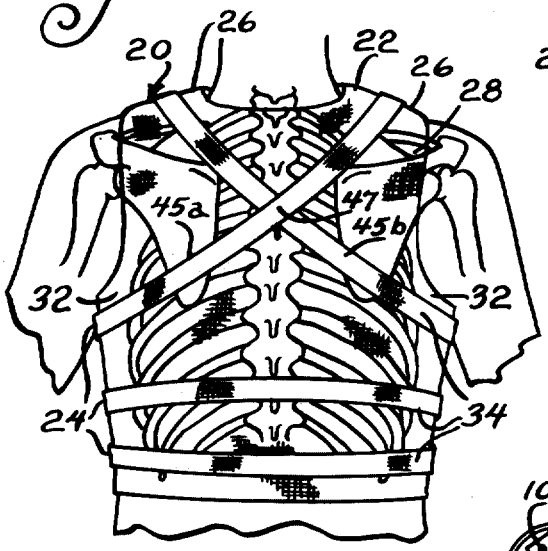
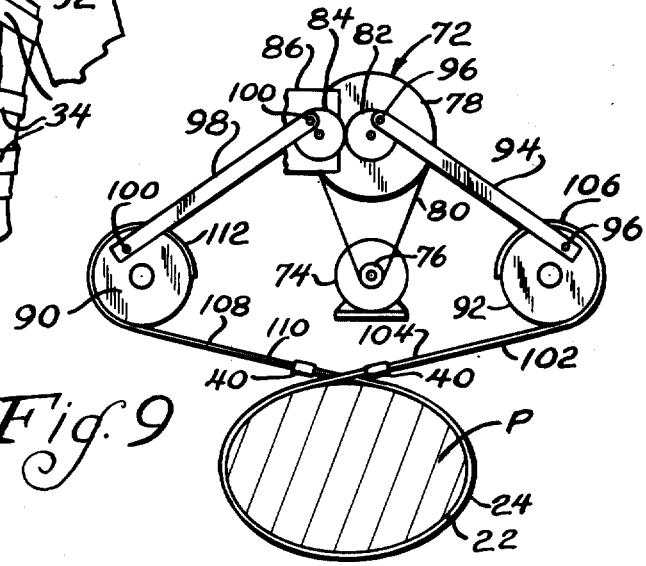
Fig. 9

RESPIRATORY ASSIST DEVICE

BACKGROUND OF THE INVENTION

The present invention relates to respiratory devices, and more particularly to devices to assist expiration.

Of the various chronic respiratory diseases, the most common is emphysema, which may be defined as alveolar distension and progressive loss of elasticity of the lung and surrounding tissues. Normally, expiration is a relatively passive act, since air is expired due to elastic recoil. Normal breathing is also accompanied by a bellows action of the ribs, particularly the more mobile lower ribs, which are depressed and elevated during expiration and inspiration.

As emphysema progresses in severity, the walls of the alveoli or air cells become less elastic, and a positive pressure becomes required in order to squeeze air from the patient's lungs and accomplish expiration. However, emphysema also causes the ribs to become fixed in an elevated position, and prevents the normal bellows action of the rib cage. Thus, the patient must labor to develop the abnormal pressure necessary to expire while being unable to use the ribs to facilitate breathing. Accordingly, respiration becomes exceedingly difficult for the patient, and virtually all of the thoracic space and most of the accessory muscles of respiration must be utilized to accomplish expiration, resulting in a series of shallow breaths and prolonged periods of expiration.

SUMMARY OF THE INVENTION

A principal feature of the present invention is the provision of a device of simplified construction to facilitate respiration by a patient.

The device of the present invention comprises, a garment of flexible material extending around the lower region of the patient's rib cage, and a plurality of elongated compression straps retained on the garment. The straps have separate sets of circumferential side portions located on the garment adjacent opposed side of the patient and disposed to cover the lower region of the patient's rib cage when the garment is worn. The straps have separate sets of end portions extending from the side portions toward a location intermediate the side portions when the garment is worn. The device also has means for separately joining different sets of said end portions.

A feature of the present invention is that the joining means may be pulled to compress the lower region of the patient's rib cage.

Among the advantages to the patient through use of the device are the following. The device may be utilized to augment the normal bellows action of the rib cage and associated musculature, with compressive forces applied to the lower region of the rib cage being transmitted to the upper, less mobile, ribs through muscle and ligamentous attachments between the ribs. The device reduces the amount of work required by accessory respiratory muscles to expire. The device also aids in respiratory exchange of oxygen and carbon dioxide, aeration of lower portions of the lungs, expulsion of secretions.

A feature of the invention is that the device may be utilized to decrease residual volume or dead air space in the lungs by decreasing the volume of the rib cage and by overcoming the abnormal elevated positions of the patient's ribs, thus facilitating expiration by the patient.

Another feature of the invention is that the device may be utilized by the patient to loosen ribs which have become relatively immobile as a result of a chronic respiratory disease.

Thus, a feature of the invention is that the device may be utilized to overcome and reverse pathologic changes normally present in the respiratory disease.

Another feature of the invention is that the device conforms to the shape of the patient.

Still another feature of the invention is that the garment serves as a cushion for the straps when pulled during expiration.

Thus, a feature of the invention is that the device is comfortable to the patient during use.

Yet another feature of the invention is that the garment maintains the straps in the desired position over the lower region of the rib cage during use of the device.

A feature of the invention is that the straps may be pulled in varying directions to selectively apply compressive forces against different parts of the rib cage.

Another feature of the invention is the provision of pull straps connected to the joining means to facilitate manipulation of the device.

Still another feature of the invention is the provision of mechanical means to pull the straps without exertion of work by the patient.

Yet another feature of the invention is the provision of a belt for encircling the patient below the rib cage.

A feature of the invention is that the belt directs upward movement of the patient's diaphragm during compression of the rib cage by manipulation of the device.

Further features will become more fully apparent in the following description of the embodiments of this invention and from the appended claims.

DESCRIPTION OF THE DRAWINGS

In the drawings:

FIG. 5 is a fragmentary elevational view of another embodiment of the respiratory assist device of the present invention;

FIG. 6 is a back elevational view of another embodiment of the respiratory assist device of the present invention;

FIG. 7 is a back elevational view of another embodiment of the respiratory assist device of the present invention;

FIG. 9 is a schematic view of a mechanical device of the present invention for use in conjunction with the respiratory assist device.

DESCRIPTION OF THE PREFERRED EMBODIMENTS

Figure 2:
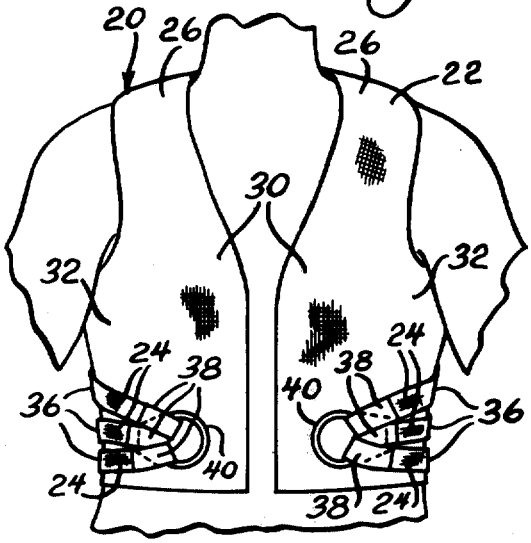
FIG. 2 is a front elevational view of a respiratory assist device of the present invention.
Figure 3:
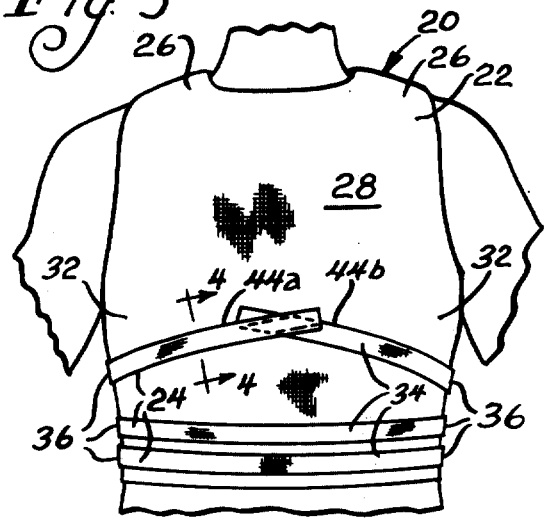
FIG. 3 is a back elevational view of the respiratory assist device of FIG. 2.

Referring now to FIGS. 2 and 3, there is shown a respiratory assist device generally designated 20 for use by a patient having a chronic respiratory disease, such as emphysema. The device 20 has a vest-like garment 22 of flexible tear-resistant material, and a plurality of elongated flexible compression straps 24. In a preferred form, the garment 22 has a pair of shoulder portions 26, a back 28, an open front 30, and sides 32 connecting the back 28 and front 30. As shown, when the garment 22 is placed on a patient, the lower portion of the garment overlies the lower region of the patient's rib cage. The straps 24 have back portions 34 extending around the back 28 of the garment 22, side portions 36 extending from the back portions 34 around the sides 32 of the garment 22, and front end portions 38 extending from the side portions 36 toward the front of the garment from opposed directions when the garment is worn. In a preferred embodiment, as shown, the end portions 38 are passed through a pair of loops or rings 40, and are secured in place by suitable means, such as by lines of stitching, to join the end portions 38 to the rings 40. Thus, the straps 24 pass around the back 28 and sides 32 of the garment toward the garment front 30 where they are joined together by the pair of rings 40.

Figure 4:
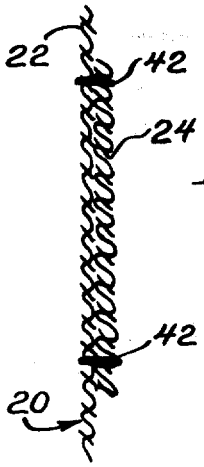
FIG. 4 is a fragmentary sectional view taken substantially as indicated along the line 4—4 of FIG. 3.

The back portions 34 and side portions 36 are retained on the garment 22 in a spaced configuration, such that these portions of the straps generally overlie the lower region of the patient's rib cage. The straps may be retained or secured to the garment in the desired position by any suitable means, such as by lines of stitching 42 passing through the straps and garment 22, as illustrated in FIG. 4. As shown in FIG. 3, the lowermost straps may completely encircle the lower back of the garment, and the uppermost strap may have separate segments 44*a* and 44*b* to increase the spacing between the uppermost strap and the lower straps, as shown. Alternatively, all of the straps may encircle the back 28 of the garment 22, as shown in FIG. 6, or the uppermost strap may comprise separate sections 45*a* and 45*b* which cross each other at location 47 on the back of a garment and terminate on the different shoulder portions 26, as illustrated in FIG. 7.

In use, the garment 22 is placed on the patient, as illustrated in FIGS. 2 and 3. The patient may insert the thumb or fingers of his right hand into the left ring 40, and the thumb or fingers of his left hand into the right ring 40, after which the patient may pull both rings to exert forces against the straps 24. When pulled, the straps 24 exert compressive forces against the lower region of the patient's rib cage, such that the lower ribs are depressed from an elevated position with the compressive forces exerted against the lower ribs being transmitted to the upper less mobile ribs through muscle and ligamentous attachments between the ribs. Accordingly, the rib cage is compressed through slight tugging action by the patient on the rings 40, causing a decrease in the residual volume or dead air space in the lungs and resulting in development of a positive pressure to facilitate expiration by the patient. Thus, the device 20 may be sequentially pulled and released by the patient to accomplish breathing with a minimal amount of effort being required to manipulate the device. Additionally, the device loosens the ribs which have become fixed as a result of the chronic respiratory disease, and thus serves to retard and reverse pathologic changes normally present in the disease.

During use of the device, the garment 22 maintains the straps at the desired position over the lower region of the rib cage, and the rings 40 may be pulled in varying directions to selectively apply compressive forces against different parts of the rib cage. Additionally, the garment readily conforms to the particular shape of the patient, and serves as a cushion for the straps when the device is manipulated to provide comfort for the patient.

Figure 1:
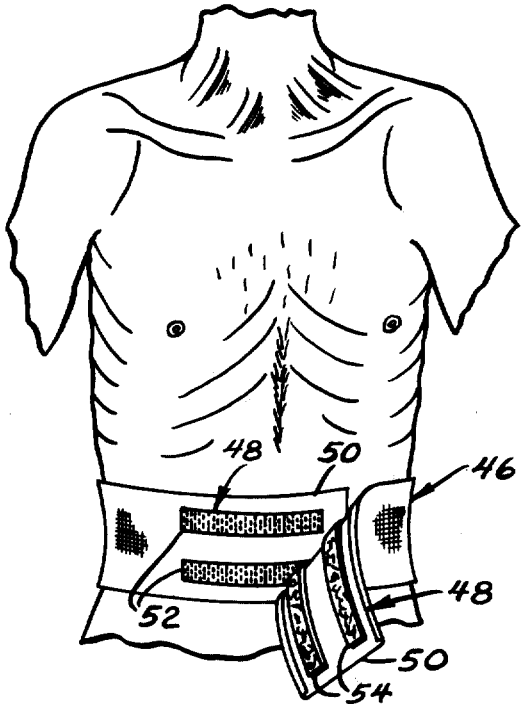
FIG. 1 is a perspective view of an abdominal belt of the present invention.

Referring to FIG. 1, there is shown a relatively wide belt 46 of flexible material having a sufficient length to encircle the abdominal region of the patient. The belt 46 may have suitable fastening means 48 on opposed ends 50 of the belt 46, such as hook and loop fastening strips 52 and 54, as shown, to releasably secure the belt 46 snugly around the patient below the rib cage. The belt 46 may be utilized in conjunction with the device 20 to prevent downward movement and direct upward movement of the patient's diaphragm when the device 20 is manipulated. Thus, with the belt 46 properly secured about the patient, the belt 46 maintains the diaphragm in position such that it moves upwardly and further facilitates expiration when the device 20 is pulled to compress the rib cage.

Figure 8:
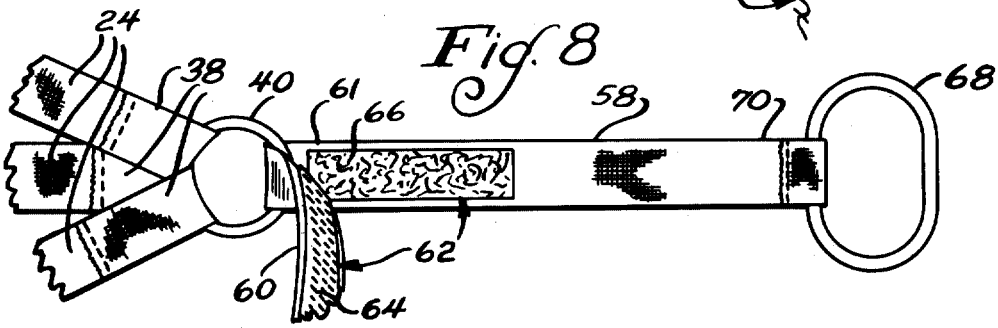
FIG. 8 is a fragmentary plan view of a pull strap for the respiratory assist device of the present invention.

Another embodiment of the respiratory assist device 20 of the present invention is illustrated in FIG. 5 in which like reference numerals designate like parts. In this embodiment, the device 20 has a pair of pull straps 58 having one end 60 passing through and secured around the rings 40. Thus, the pull straps 58 may be utilized by the patient to pull against the rings 40 and straps 24 in opposed directions to manipulate the device and compress the rib cage during expiration. As illustrated in FIG. 8, the ends 60 of the straps 58 may be passed through and secured about the rings 40 against adjoining portions 61 of the strap 58 by suitable fastening means 62, such as the hook and loop fastening strips 64 and 66, as shown. Thus, the pull straps 58 may be releasably attached to the rings 40, in order that the patient may either use the rings 40 without the pull straps 58, or use the pull straps 58 in conjunction with the rings 40 to manipulate the device, as desired. As shown, the pull straps 58 may have loops or rings 68 located adjacent the outer ends 70 of the pull straps 58, with the ends 70 of the pull straps 58 being passed through the loops 68 and secured in place by suitable means, such as by lines of stitching. Accordingly, the loops 68 may be utilized by the patient to pull on the straps 58 while manipulating the device.

Referring now to FIG. 9, there is shown a device 72 which is utilized to pull the straps 24 retained on the garment 22. The device 72 has suitable drive means, such as a motor 74, having a relatively small pulley 76 secured to and driven by a drive shaft of the motor 74. The pulley 76 is connected to a relatively large pulley 78 by an endless belt 80 which passes around the pulleys 76 and 78. Thus, rotation of the smaller pulley 76 results in relatively slow rotation of the larger pulley 78.

A circular clutch member 82 is connected to the pulley 78 in a concentric relationship, such that the member 82 rotates with the pulley 78 until a predetermined amount of force resisting rotation is applied to the clutch member 82, at which time the member 82 begins to slip. A circular member 84 is rotatably mounted on a plate 86, such that its outer surface bears upon and frictionally engages the outer surface of the clutch member 82. Thus, the clutch member 82 drives the member 84 in an opposite rotational direction until the member 82 is released from driving engagement with the pulley 78 by the clutch.

The device 72 also has a pair of spaced pulleys 90 and 92 which are rotably mounted on opposed sides of the patient P. A first arm 94 is pivotally connected between the clutch member 82 and pulley 92 by a pair of pins 96, while a second arm 98 is pivotally connected between the member 84 and pulley 90 by a pair of pins 100. As shown, a connecting strap 102 has one end 104 connected to the loop 40, while its other end 106 is secured to and wound around the pulley 92. A second strap 108 has one end 110 connected to the other loop 40, while the other end 112 of the strap 108 is secured to and wound around the pulley 90.

In use, the device 72 operates in the following manner. When the motor 74 drives the pulley 76 in a counterclockwise direction, as viewed in the drawing, the pulley 78 and clutch member 82 are also driven in a counterclockwise direction, while the member 84 is driven by member 82 in a clockwise direction, such that the spacing between the pins 96 and 100 on the members 82 and 84, respectively, is reduced. Thus, during this mode of operation, the arm 94 drives the pulley 92 in a counterclockwise direction, while the arm 98 simultaneously drives the pulley 90 in a clockwise direction, such that the straps 102 and 108 are wound onto the pulleys 92 and 90, respectively. Accordingly, when the motor 74 drives the pulley 76 in a counterclockwise direction, the device exerts pulling forces against both loops 40 and the straps 24, which in turn causes compression of the patient's rib cage to facilitate expiration. The device continues to apply compressive forces against the patient until the clutch member 82 is actuated to limit the maximum amount of compressive forces applied by the device against the patient, and thus prevent harm to the patient. In a preferred form, the clutch member 82 is arranged to gradually relieve such compressive forces.

It will be apparent that when the motor 74 is reversed to drive the pulley 76 in a clockwise direction, the pulleys 90 and 92 are driven in reverse rotational directions from that previously described, such that the connecting straps 102 and 108 are unwound from the pulleys 92 and 90, respectively, resulting in relaxation of the straps 24 to relieve pressure from the patient's rib cage. In this manner, the motor 74 may be sequentially driven in reverse directions at timed intervals to sequentially apply controlled compressive forces against the patient and relieve such forces during expiration and inspiration, respectively, ahd facilitate respiration.

The foregoing detailed description is given for clearness of understanding only, and no unnecessary limitations should be understood therefrom, as modifications will be obvious to those skilled in the art.

1 claim:

1. A respiratory assist device, comprising:

a garment of flexible material extending around the lower region of a wearer's rib cage;

a plurality of elongated compression straps retained on the garment, said straps having separate sets of circumferential side portions located on the garment adjacent opposed sides of the wearer and disposed to cover the lower region of the wearer's rib cage when the garment is worn, and having the separate sets of end portions extending from said side portions toward a location intermediate said side portions when the garment is worn; and means for effectively separately joining different sets of said end portions on each side, whereby the joining means may be pulled to compress the lower region of the wearer's rib cage and facilitate expiration.

2. The device of claim 1 wherein said garment comprises a vest.

3. The device of claim 1 including means for securing the straps to the garment.

4. The device of claim 3 wherein the securing means comprises lines of stitching extending through the straps and garment.

5. The device of claim 1 wherein the joining means comprises a pair of loops, with each set of said end portions passing through one of said loops.

6. The device of claim 1 including a pair of pull straps, with each of said pull straps being connected to one of said joining means.

7. The device of claim 6 including means for releasably connecting said pull straps to said joining means.

8. The device of claim 6 including a pair of handle means connected to said pull straps at a location remote said joining means.

9. The device of claim 1 including mechanical means for sequentially applying pulling forces against each of said joining means in a direction generally toward each other and for sequentially releasing said joining means.

10. The device of claim 9 including means for limiting the magnitude of said pulling forces.

11. The device of claim 1 wherein the device has three compression straps.

12. The device of claim 1 including a relatively wide belt having a sufficient length to encircle the wearer in the region of the abdomen, and means for releasably securing the belt about the wearer below the rib cage.

13. A respiratory assist device, comprising;

a vest-like garment of flexible material having shoulder portions, a back, an open front, and sides connecting said back and front;

a plurality of elongated compression straps secured to said garment, said straps extending from the back of the garment around said sides toward the garment front, with portions of said straps located on the garment sides and back being disposed in a spaced relationship on said garment over the lower region of a wearer's rib cage when the garment is worn, and with said straps having end portions adjacent the garment front; and means for effectively separately joining the strap end portions on each side, whereby the joining means may be pulled to compress the lower region of the wearer's rib cage and facilitate expiration.

14. The device of claim 13 wherein at least a part of said plural straps encircle the back of the garment.

15. The device of claim 14 wherein all of said straps encircle the back of the garment.

16. The device of claim 14 wherein a pair of uppermost straps extend across each other on the back of the garment, and each extend to a location adjacent different shoulder portions.

17. A respiratory assist device, comprising:

a plurality of elongated compression straps having back portions extending around a wearer's back, side portions extending from said back portions around opposed sides of the wearer, and end portions extending from said side portions in opposed directions toward a location intermediate said side portions;

means for maintaining said back and side portions in a spaced relationship over the lower region of the wearer's rib cage; and means for effectively separately joining said end portions on each side, whereby the joining means may be pulled to compress the lower region of the wearer's rib cage and facilitate expiration.

18. A respiratory assist device, comprising:

a vest-like garment of flexible material having a back, an open front, and sides connecting said back and front;

flexible strap means retained on the garment and extending from the garment back around both sides of the garment toward said garment front, said strap means having a sufficient breadth to effectively overlie the lower region of a wearer's rib cage adjacent both sides of the wearer when the garment is worn; and means associated with said strap means for pulling the strap means from opposed directions to compress the lower region of the wearer's rib cage and facilitate expiration.

19. A respiratory assist device, comprising in combination;

flexible compression means for at least partially encircling the lower region of a wearer's rib cage and handle means for sequentially applying compressive forces against said region to facilitate expiration; and a relatively wide flexible belt having a sufficient length to separately encircle the wearer in the region of the abdomen lower than said compression means, said belt having means for releasably securing the belt snugly about the wearer below the rib cage to direct upward movement of the wearer's diaphragm when said rib cage region is compressed.

20. A respiratory assist device, comprising:

a garment of flexible material extending around the lower region of a wearer's rib cage;

a plurality of elongated compression straps retained on the garment, said straps having separate sets of circumferential side portions located on the garment adjacent opposed sides of the wearer and disposed to cover the lower region of the wearer's rib cage when the garment is worn, and having separate sets of end portions extending from said side portions toward a location intermediate said side portions when the garment is worn;

a pair of pull straps; and means for separately connecting said pull straps to different sets of said strap end portions, whereby the pull straps may be pulled in varying directions to selectively apply compressive forces through different compression straps against different parts of the rib cage.

* * * * *